US005567924A

United States Patent [19]

Yano et al.

[11] Patent Number: 5,567,924

[45] Date of Patent: Oct. 22, 1996

[54] CIRCUIT BREAKER WITH PARALLEL RESISTOR

[75] Inventors: Makoto Yano, Mito; Masanori Tsukushi; Noriyuki Yaginuma, both of Hitachi, all of Japan

[73] Assignee: Hitachi, Ltd., Tokyo, Japan

[21] Appl. No.: 411,315

[22] Filed: Mar. 28, 1995

[30] Foreign Application Priority Data

Mar. 31, 1994 [JP] Japan ..... 6-062482

[51] Int. Cl.[6] ..... H01H 9/30

[52] U.S. Cl. ..... 218/143; 335/6

[58] Field of Search ..... 335/78–86, 6; 218/143

[56] References Cited

U.S. PATENT DOCUMENTS

| | | | |
|---|---|---|---|
| 4,539,448 | 9/1985 | Schulz | 218/143 |
| 5,225,642 | 7/1993 | Yamamoto et al. | 218/143 |
| 5,391,930 | 2/1995 | Ohshita et al. | 218/143 |

FOREIGN PATENT DOCUMENTS

| | | |
|---|---|---|
| 1-246732 | 10/1989 | Japan . |
| 3-4418 | 1/1991 | Japan . |
| 3-297021 | 12/1991 | Japan . |
| 4-286822 | 10/1992 | Japan . |

*Primary Examiner*—Lincoln Donovan

*Attorney, Agent, or Firm*—Fay, Sharpe, Beall, Fagan, Minnich & McKee

[57] ABSTRACT

A circuit breaker with parallel resistor which can satisfy contradictory requirements to induce a preliminary discharge at the time of closing action and to maintain a high interelectrode insulation at the time of interrupting action has been provided in a simple and compact size. The circuit breaker of the invention includes movable unit 41 and stationary unit 31 both on the side of main contact S1, and movable unit 21 and stationary unit 11 both on the side of resistance closing contact S2, wherein the movable unit 21 on the side of the resistance closing contact S1 comprises shield 23 which is adapted either to move lagging behind the movement of movable electrode 22 or to open at its front side during closing action of the circuit breaker such that a preliminary discharge is readily generated between the movable electrode 22 and the stationary electrode 23 in precedence to the main contact. On the other hand, during interrupting action, the shield 23 returns to its original state to enclose the front end portion of the movable electrode 22 thereby to enhance its field relaxation effect and suppress any discharge therefrom.

20 Claims, 6 Drawing Sheets

CIRCUIT BREAKER WITH PARALLEL RESISTOR

BACKGROUND OF THE INVENTION

The present invention relates to a gas-insulated circuit breaker, and in particular, it relates to a circuit breaker having a parallel resistor for suppressing the occurrence of arc when making contact.

When closing a non-loaded power transmission line by means of a circuit breaker, it has been known to use a circuit breaker having a parallel resistor in order to suppress an overvoltage which occurs as a closing switching surge. An equivalent circuit thereof is shown in FIG. 3, and a timing chart indicative of closure and interruption of the circuit breaker is shown in FIG. 4, respectively.

This circuit breaker is comprised of a main contact S1 that has a current interruption capability, a resistor 16 and a resistor closing contact S2 both coupled in parallel with the main contact.

When closing the circuit breaker, resistor closing contact S2 is closed at time t1 preceding time t2 at which the main contact S1 is to be closed so that resistor 16 is inserted into the circuit to cause a preliminary discharge to occur through the resistor closing contact S2 in precedence. This method is widely applied for suppressing closing switching surges, since when it is applied, for example, to a 500 kV power transmission system, a value of multiple of overvoltages imposed on closing of the circuit breaker can be limited to less than 1.7 by setting a value of resistor at several hundred ohms and a time difference at approximately 0.5 cycle between the closures of the resistor closing contact and the main contact.

On the other hand, since the resistor closing contact S2 has little current interruption capability, at the time of interrupting operation of the main contact S1, the resistor closing contact S1 must be opened at time t3 preceding time t4 at which the main contact S1 is opened to effect interruption in order to ensure inter-electrode isolation of the resistor closing contact S2 to be maintained, thereby requiring a different operational characteristic from that at the time of the closing operation.

One typical example of such prior art circuit breakers with parallel resistor is shown in FIG. 9. FIG. 9(*a*) is a cross-sectional view in part of a schematic construction thereof, and FIG. 9(*b*) is a cross-sectional view of a resistor closing contact S2 for use therein in its full open state (at its maximum distance).

In the drawings of FIG. 9, main contact S1 and resistor closing contact S2 are disposed inside a hermetically sealed chamber (not shown) filled with arc-extinction gas.

The main contact S1 that has a current interruption capability comprises a stationary unit 31 and a movable unit 41. The resistor closing contact S2 comprises a stationary unit 11' and a movable unit 21'.

Stationary unit 31 on the side of the main contact S1 comprises a stationary contact 32 and an electric field relaxation shield 33 that surrounds the stationary contact 32. On the other hand, the movable unit 41 on the side of the main contact S1 includes a movable contact 42 attached to a cylinder 44. The cylinder 44 and a piston 45 constitute a gas compression unit which responsive to interrupting (opening) operation of both contacts 32 and 42 compresses a filled gas and blows it between the contacts to extinguish arc through an insulation nozzle 43.

The stationary unit 11' on the side of the resistor closing contact S2, which is firmly attached to the stationary unit 31 on the side of the main contact S1 via a support fixture 34, comprises a stationary electrode 12, a stationary shield 13, a resistor 16 coupled to the stationary electrode 12 via a conducting support member 15, and the like, wherein the stationary electrode 12 is supported by the support member 15 via a spring 14. On the other hand, the movable unit 21' on the side of the resistor closing contact S2 includes a movable electrode 22' which is supported by a support fixture 27 such that it can move integral with the movable unit 41 on the side of the main contact S1, and a shield 23' therefor, wherein the movable electrode 22' is coupled via its axial member 26' and coupling member 27 to the movable unit 41 on the side of the main contact S1.

At the time of closing of the circuit breaker, the movable unit 21' of the resistor closing contact S2 is directed toward the stationary unit 11' thereof integral with the movement of the movable unit 41 of the main contact S1. Since an inter-electrode length 10 in a full open state (maximum distance) of the resistor closing contact S2 is set shorter than an inter-electrode length of the main contact S1, the resistor closing contact S2 is caused to close at first with its movable electrode 22' further pushing the stationary electrode 12 inward by a distance $\mathbf{1}_w$ against the force of a spring 14, then, the main contact S1 is closed.

On the other hand, at the time of interruption of the circuit breaker, the movable unit 41 of the main contact S1 moves backward with its contacts 32 and 42 somewhat being maintained in contact. The movable unit 21' of the resistor closing contact S2 (that is, movable electrode 22' and its shield 23') which is adapted to move integral with the movable unit 41 is caused to move in the open direction at a speed of interruption of the main contact S1, however, since the spring 14 cannot follow the speed of interruption, thus the stationary electrode 12 is caused to return at a slower speed, thereby, the resistor closing contact S2 can be opened in precedence to the opening of the main contact S1.

In addition to the above-mentioned prior art, there are still other prior art circuit breakers which have employed an actuating mechanism for separately actuating the main contact and the resistor closing contact, or modified the construction of the resistor closing contact, as disclosed in JP-A-Nos. 1-246732, 3-4418, 3-297021, 4-286822.

As a duty of the resistor closing contact, it is required at the time of interrupting operation that a sufficiently higher electric field relative to that at the main contact is formed around the resistor closing contact to ensure a preceding discharge to occur, then insert the resistor in the system. On the other hand, at the time of interrupting operation, it is required to provide an appropriate structure to adequately shield the contact electrodes so as to prevent electric field concentration, and which can withstand a large transient recovery voltage which appears between the electrodes immediately upon onset of interrupting operation, thereby, a quite different characteristic in contrast with that required at the time of closing must be satisfied as well. In addition, the resistor closing contact is required to have an insulation performance as high as that of the main contact at its full open state in spite of its shorter inter-electrode distance than that of the main contact.

Along with an increasing voltage in the power transmission system nowadays, a compacter design of circuit breakers is under way, thus, insulation coordination characteristics imposed thereon are getting more and more stringent. Because of increasing difficulties by the prior art arrangements to cope with such stringent requirements, a method to operate the resistor closing contact independently has been devised as described above, however, this method would inevitably results in a complicated actuator control system.

Further, the circuit breaker described in JP-A No. 1-246732 discloses that during its closing operational stroke, the movable electrode of its resistor closing contact is protruded outside its shield, and that during its interrupting operational stroke, the movable electrode thereof is retracted inside the shield so as to improve the insulation coordination characteristics. However, there are such problems associated with the prior art circuit breakers that the internal structure of a movable unit of its resistor closing contact becomes more complicated requiring an increased number of components and parts, as well as that since the movable electrode which has been retracted inside the shield is pushed to protrude outside thereof by a push bar when it arrives at its maximum point of distance and so is set ready for the next closing operation as protruded, therefore, requiring an additional distance for its maximum inter-electrode distance to ensure adequate insulation therebetween, which is contrary to the general requirements to shorten the inter-electrode distance to manufacture a compacter circuit breaker.

SUMMARY OF THE INVENTION

The main object of the present invention is to provide a circuit breaker with a parallel resistor in a simple arrangement which can satisfy two contradictory requirements to ensure the above-mentioned preceding discharge and the inter-electrode insulation.

In order to accomplish the above-stated object of the invention, we propose the following means in order to solve the above-mentioned problems associated with the prior art.

First means for solving the problem is composed of components and parts with numerals in reference to FIG. 1.

Namely, a circuit breaker with a parallel resistor in which a resistor closing contact S2 is coupled in parallel with a current interrupting main contact S1, and contact/open of a movable electrode 22 to a stationary electrode 12 of the resistor closing contact S2 is adapted to precede close/interrupt of the main contact S1, wherein a movable unit 21 of the resistor closing contact S2 comprises a movable electrode 22 which is movable integral with a movable unit 41 of the main contact S1, and an electric field relaxation shield 23 for shielding the movable electrode 22, further wherein the shield 23 is fit around the movable electrode 22 via an elastic member 24 in such a manner that the shield 23 is movable in the axial directions relative to the movable electrode 22, thereby, when the movable electrode 22 of the resistor closing contact S2 travels toward the stationary electrode 12 thereof at the time of closing operation of the main contact S1, a relative movement to be induced by inertia between the movable electrode 22 and the shield 23 is allowed to be contained by compression of the elastic member 24, then, along with restoration of the elastic body 24, the shield 23 follows a little behind the movement of the movable electrode 22, and further wherein at the time of interrupting operation, the shield 23 which is supported on the movable electrode 22 latched by the restored elastic member 24 is caused to move toward the direction opposite to the stationary electrode integral with the movable electrode 22.

Second means for solving the problem is also on the premise that the circuit breaker is provided with a resistor closing contact S2 coupled in parallel with the main contact S1 likewise the first means described above.

With reference to FIG. 6, a movable unit 21 of a resistance closing contact S2 includes a movable electrode 22 which is movable integral with the movable unit 41 of the main contact S1 (not shown), and an electric field relaxation shield 23 for shielding the movable electrode 22.

In the above arrangement, the electric field relaxation shield 23 is fit around the movable electrode 22 in a manner movable in the axial directions and relative to each other. An elastic body 70 is interposed between the inner surface of the shield 23 and the outer surface of the movable electrode 22. One end of the elastic body 70 facing a stationary unit 11 of the resistor closing contact S2 is fastened to a stopper 25' provided on the outer surface of the movable electrode 22, while the other end of the elastic body 70 remote from the stationary unit 11 is fastened to an inner rear wall of the shield 23. Further, during an interrupting operation of the main contact S1, the shield 23 is stopped of its backward movement by a shield stopper member 71 placed at a distance less than a predetermined maximum open distance for the movable electrode 22 prescribed relative to the stationary electrode 12 of the resistor closing contact S2. Then, a further retreat only of the movable electrode 22 is enabled to its predetermined maximum open distance, with the elastic body 70 being compressed, and the movable electrode 22 being retracted into the shield 22. Then, during closing operation, when the movable electrode 22 is caused to advance toward the stationary electrode 12, the elastic body 70 is released of its compression to its free length and temporarily beyond thereof due to its reaction such that the shield 23 lags behind the movable electrode 22 in its movement.

Third means for solving the problems associated with the prior art is also on the premise that a circuit breaker with a parallel resistor having the main contact S1 and the resistor closing contact S2 is utilized likewise the first and the second means described above, in which the movable unit 21 of the resistor closing contact S2 includes a movable electrode 22 that is movable integral with the movable unit 41 of the main contact S1, and a shield 23 for shielding the movable electrode 22.

With reference to FIG. 7, the shield 23 in the above arrangement of the third means is comprised of shield elements **23*a* and 23*b* dividable into two pieces which face one end of the movable electrode 22 and can be opened around a pivot on the axial line of the movable electrode 22** to allow it to protrude.

Further, there is provided a mechanism to allow the shield elements **23*a*, 23*b* temporarily to open only when the movable electrode 22 of the resistor closing contact S2 is caused to advance toward a stationary electrode 12 during a closing operation of the main contact S1**.

Action of the first means for solving the problems described above is that when the movable electrode 22 is positioned at its maximum open distance, the remotest from the stationary electrode 12 of the resistor closing contact S2, in an open state of the circuit breaker, the shield 23 is adapted to substantially surround the movable electrode 22 in order to relieve an electric field concentration at an edge of the movable electrode 22. That is, the contact end of the movable electrode 22 is retracted not to protrude from a line of curve extending between the ends of the shield elements to enhance its electric field relaxation effect.

Upon onset of a closing operation of the main contact S1, the movable electrode 22 is caused to move toward the stationary electrode 12 to make contact therewith, the shield 23 on the movable electrode, however, lags the movable electrode 22 in its movement due to inertia. In this instant, a relative movement between the movable electrode 22 and the shield 23 is allowed by compression of the elastic body 24 in such a manner as to protrude temporarily the movable electrode 22 from the shield 23 during a stroke between mated electrodes, thereby reducing the shield effect, thus, in turn increasing an electric field in the vicinity of the edge portion of the movable electrode of the resistor closing contact S2, which induces a preliminary discharge to take place across the resistor closing contact S2 prior to the main contact S1.

Then, during this closing operation, the elastic body 24 restores its original state, thereby causing the shield 23 to catch up the movable electrode 22 finally, thus upon completion of making contact, the elastic body 24 surrounds the movable electrode 22 once again to enhance its electric field relaxation effect around the edge portion of the movable electrode.

At the time of an interrupting operation, since the shield 23 which is latched to the movable electrode 22 via the elastic body 24 which restored its original length is caused to move integral with the movable electrode 22 to the remote side from the stationary electrode, a high electric field shield effect is maintained, thus moderating the electrode edge portion electric field concentration. Therefore, there will occur no rearcing on the side of the resistor closing contact S2 during interrupting operation, thus capable of maintaining a high insulation performance. Each aspect of operational sequences described above will be further detailed by way of example of steps (a) to (d) of FIG. 2 with reference to one embodiment of the invention.

Further, even in a state after completion of the interrupting operation, the relative position between the movable electrode 22 and the shield 23 restored during the foregoing interrupting operation can be maintained, thereby ensuring an adequate shield effect to be achieved, and maintain a high insulation performance.

Action of the second means for solving the problems described above will be set forth in the following. In a state of the circuit breaker when it is full open, that is, when the movable electrode 22 of the resistor closing contact S2 is positioned at its maximum open distance from the stationary electrode 12 thereof, the elastic body 70 interposed between the shield 23 and the movable electrode 22 is in a state of compression due to combined operation of the shield stopper member 71 and the relative movement between the shield 23 and the movable electrode 22, and thus the movable electrode 22 is in a state of being retracted into the shield 23. Thereby, the shield 23 surrounds the movable electrode 22 to relax the field concentration around the edge portion thereof, and maintain a high insulation performance.

On the other hand, upon entering into a closing operation, when the movable electrode 22 moves toward the stationary electrode 12, compression of the elastic body 70 is released such as temporarily to expand its length beyond its free length due to the reaction of the compression, thereby, the shield 23 is pulled backward to recede in the direction opposite to the closing direction relative to the movable electrode 22. At this moment, the edge portion of the movable electrode 22 is caused to protrude from the movable shield 23 thereby inducing an electric field concentration in the vicinity thereof, and thus it is arranged such that a preliminary discharge tends to occur on the side of the resistor closing contact S2 in precedence to the main contact S1.

Then, at the instant the closing operation is completed, the spring 70 returns to and retains its free length, i.e., original state without compression nor tension. Therefore, by setting relative positions of the shield 23 and the movable electrode 22 such that a front end of the movable electrode 23 will not protrude from a virtual line extending between the front ends of the shield 23, with the spring 70 being in the state of its free length, the shield 23 will be able to accomplish one of its purposes to relax the electric field concentration at the movable electrode front end and demonstrate its high withstand voltage effect.

Further, since, even in the interrupting operation, the same effect of the shield 23 to relax the electric field concentration as attained in the closing operation described above is maintained, there will occur no rearcing on the side of the resistor closing contact S2, thus its high insulation capability can be maintained.

When the movable electrode 22 recedes to a position of a shield stopper 71 in front of the predetermined maximum open distance prescribed therefor relative to the stationary electrode 12, the shield 23 is stopped of its movement by the shield stopper 71. Thereby, any further regression is allowed only to the movable electrode 22, involving compression of the elastic body 70. In this instant, the movable electrode 22 is retracted into the shield 23, thereby maintaining a high interelectrode insulation capability. This state is retained after completion of the interrupting operation. This series of operation will be described further by way of example of steps (a) to (c) of FIG. 6 illustrative of one embodiment of the invention.

Action of the third means for solving the problems associated with the prior art will be described in the following. With reference to FIGS. 7 (*a*),(*b*),(*c*), when the circuit breaker is in a state of interruption, and an interelectrode open distance for the resistor closing contact S2 is at its maximum distance, shield elements 23*a*, 23*b* are closed sufficiently to surround movable electrode 22 such that shield 23 performs an electric field relaxation action for the front end of the movable electrode 22 likewise the first means.

Next, when it enters into a closing action, and the movable electrode 22 advances to the stationary electrode 12, shield elements 23*a*, 23*b* which are temporarily opened at their front ends accompany the movement of the movable electrode 22. At this instant, the front end of the movable electrode 22 protrudes from the shield elements 23*a*, 23*b* to be exposed to the electric field, thus, inducing an intensive electric field concentration in the vicinity thereof, thereby, it is arranged such that a preliminary discharge tends to occur on the side of the resistor closing contact in precedence to the main contact S1.

When the closing action is completed, the shield elements 23*a*, 23*b* are closed to surround the movable electrode 22 to ensure the field relaxation action to be attained for the front end of the movable electrode.

Even in an interrupting action, since the state of completion of the closing action is retained, namely, the shield elements 23*a*, 23*b* are closed, the foregoing action of field relaxation is maintained, thus a high interelectrode insulation capability is maintained. The action of the third means for solving the problems associated with the prior art is set forth more in detail by way of example of the steps (a) to (c) of FIG. 7 illustrative of another embodiment of the invention.

BRIEF DESCRIPTION OF THE DRAWINGS

The advantages, merits and other aspects of the present invention can be more clearly understood in reference to the accompanying drawings, in which:

FIG. 2 2A–D illustrate respective operational steps of the first embodiment;

PREFERRED EMBODIMENTS

With reference to FIGS. 1, and 5–8, preferred embodiments of the invention will be described in the following.

Figure 1:
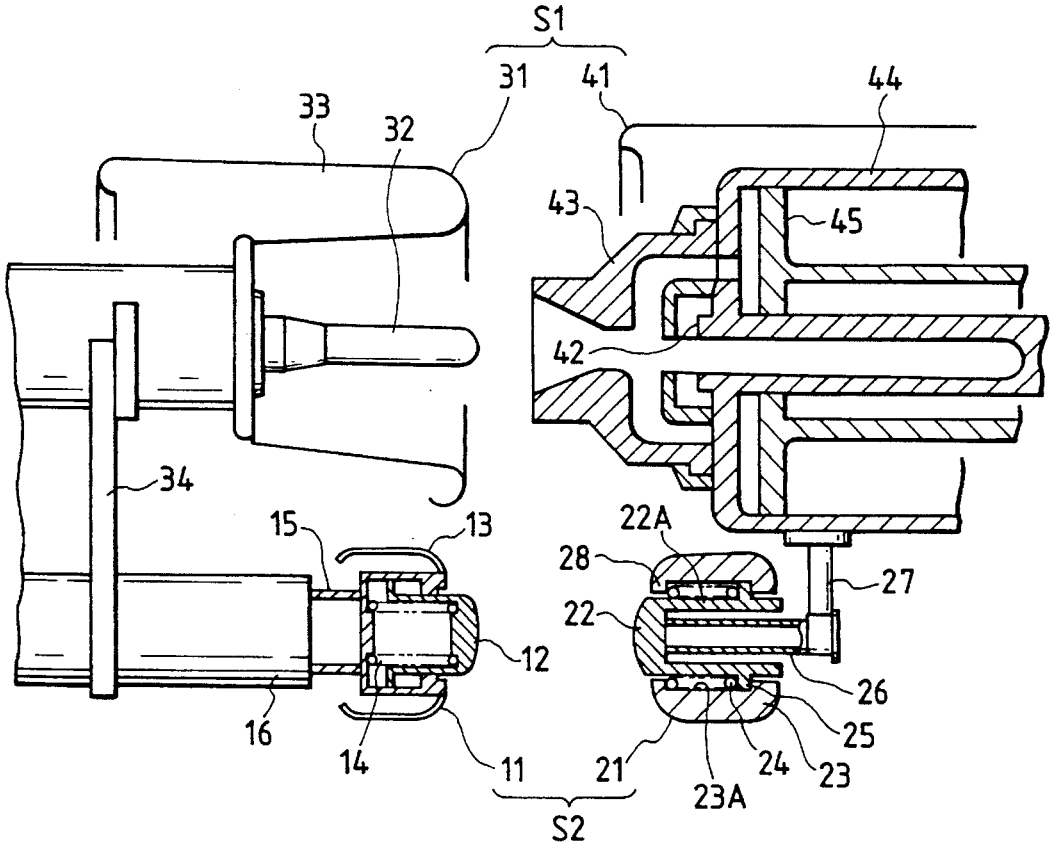
FIG. 1 is a schematic cross-sectional view of a first embodiment of the invention.
Figure 2A:
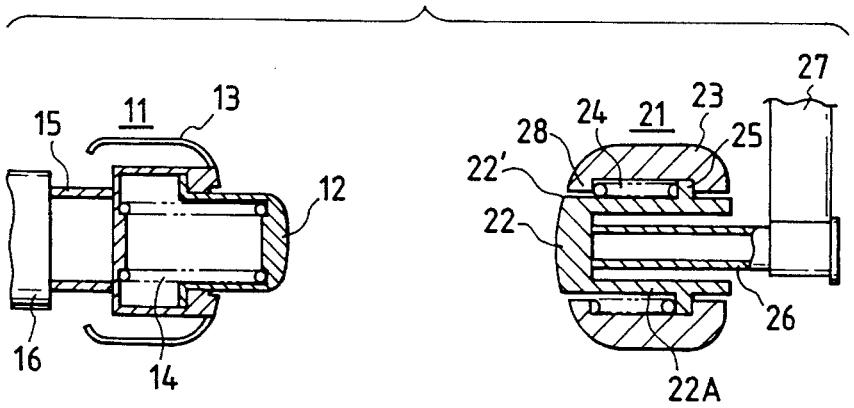
Figure 2B:
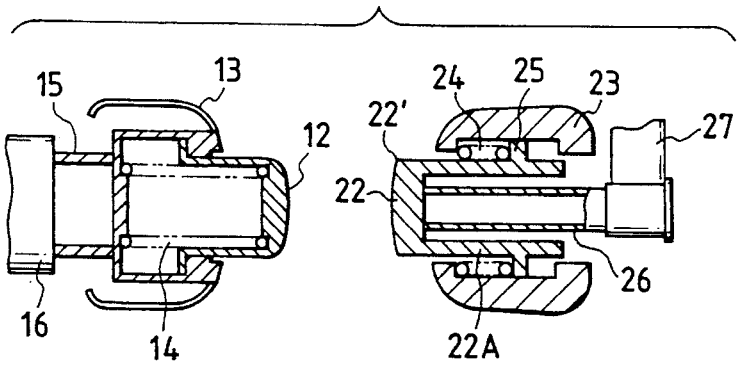
Figure 2C:
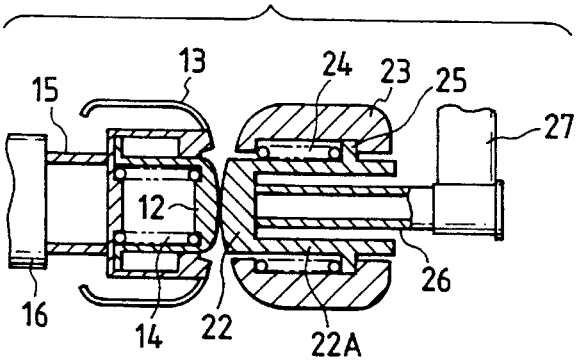
Figure 2D:
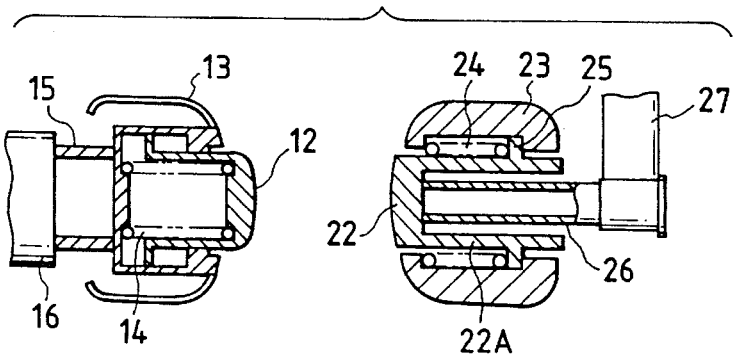
Figure 3:
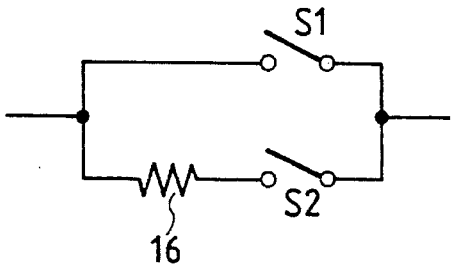
FIG. 3 is an equivalent circuit of a circuit breaker with parallel resistance.
Figure 4:
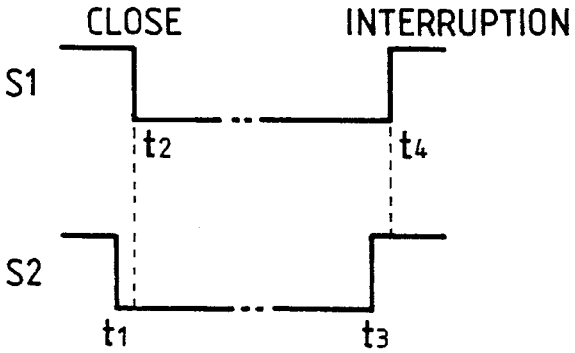
FIG. 4 is a time chart indicative of operational characteristics of respective contacts in the circuit breaker with parallel resistance.

FIG. 1 is a cross-sectional view of a schematic block diagram of one preferred embodiment of the invention, and FIG. 2 is a schematic diagram indicative of steps of its action and operation.

Figure 9A:
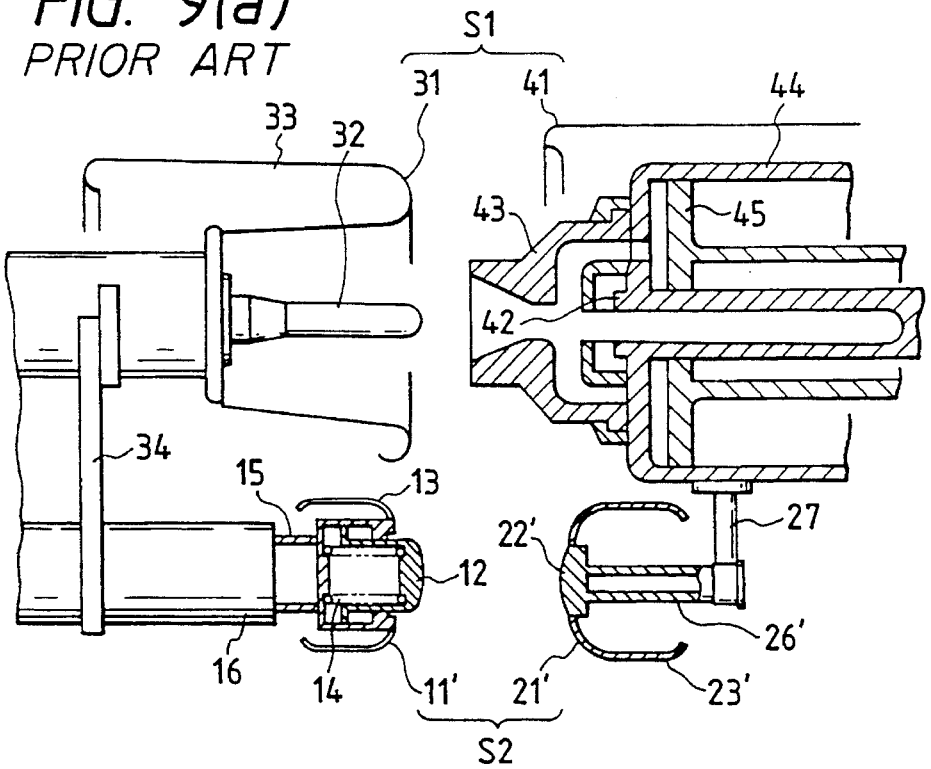
FIG. 9(a) PRIOR ART
FIG. 9A–B are a diagram illustrative of a prior art circuit breaker with parallel resistor.
Figure 9B:
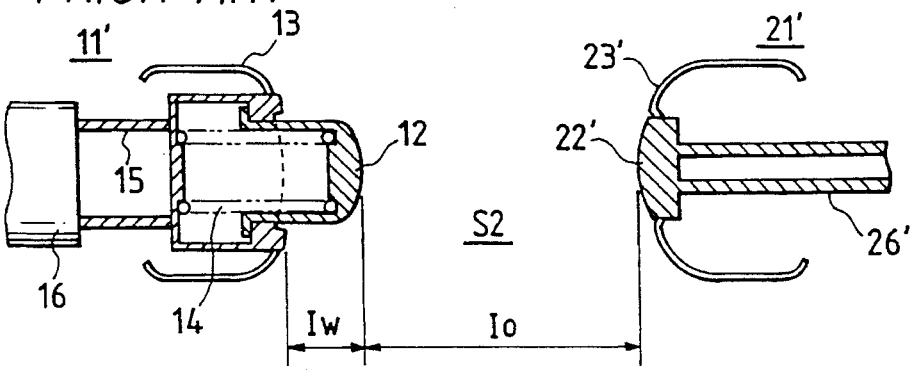
FIG. 9(b) PRIOR ART

Since the structure of its main contact S1 is the same as that of the prior art described above with reference to FIG. 9, its description will be omitted, and thus, a structure of its resistor closing contact S2 will be mainly described here.

Now, in the drawing of FIG. 1, movable unit 21 on the side of resistor closing contact S2 has such an arrangement that axial portion 26 of the movable electrode 22 thereof is connected via connecting member 27 to movable unit 41 on the side of main contact S1 such that the movable electrode 22 is adapted to be movable integral with the movable unit 41 on the side of the main contact S1. The movable unit 41 on the side of the main contact S1 is adapted to be movable in the axial directions of the main contact S1 relative to stationary unit 31 actuated by drive means which is not shown in the drawing.

Movable shield 23 on the side of the resistor closing contact S2 is fit around the outer surface of a drum portion 22A of the movable electrode 22 and is connected therebetween via an elastic body 24 which is a spring in this embodiment such that the shield 23 is set movable in the axial directions relative to the movable electrode 22. As will be detailed later, the above arrangement will provide for a mechanism which, when the movable electrode 22 of the resistor closing contact S2 is caused to move to the stationary electrode 12 during the closing action of the main contact S1, will allow a relative motion due to inertia between the movable electrode 22 and the shield 23 by spring 24 in compression, then a retarded motion of the shield 23 relative to the movable electrode 22 in its forward motion during restoration of the spring 24 to its free length. Further, during interrupting operation of the main contact S1, it is arranged such that the shield 23 is adapted to move integral with the movable electrode 22 in the opposite direction from the stationary electrode since the shield 23 is latched by the spring 24 which restored its original free length to the movable electrode 22 of the resistor closing contact S2.

In this embodiment of the invention, spring 24 is interposed between the inner surface of the shield 23 and the outer surface of the movable electrode 22, with one end of the spring 24 nearer to stationary unit 11 of the resistor closing contact S2 being fastened to the inner surface of the shield 23 while the other end thereof remote from the stationary unit being fastened to a stopper 25 provided on a drum surface 22A of the movable electrode 22. The stopper 25 is of a flange type. A front end opening of the shield 23 borders on a front end of the movable electrode 22. An annular recess 23A is formed in the inner surface of the shield 23 to secure a space to accommodate the spring 24 and the stopper 25.

The structure of the stationary unit 11 on the side of the resistor closing contact S2 is the same as that of the prior art described above in reference to FIG. 9, in which stationary electrode 12 supported by a wipe spring 14 is fit into stationary shield 13 in such a manner to be retractable in the axial directions thereof.

An interelectrode distance of the resistor closing contact S2 at its maximum open length is shorter than an interelectrode distance of the main contact S1.

With reference to FIG. 2, action of the first embodiment of the invention will be set down in the following.

In the drawing of FIG. 2, respective states of action of only the resistor closing contact are discussed during a cycle of closing and interrupting of the circuit breaker, in which FIG. 2(*a*) indicates a state where an interelectrode distance of the resistor closing contact S2 is in its full open state, FIG. 2(*b*) indicates a state in a closing action, FIG. 2(*c*) indicates a state where the closing action is completed, and FIG. 2(*d*) in a state where an interruption action is under way.

In the drawing of FIG. 2(*a*), the spring 24 is at its free length. In this instance, a front end portion of the shield 23 is either on a curve extending from the front curvature of the movable electrode 22 or protrudes therefrom, in other word, the front edge curvature of the movable electrode 22 will never protrude from a curve extending along the frontal curvature of the shield 23. Accordingly, edge portion 22' of the movable electrode 22 in the vicinity of which a discharge readily occurs is surrounded adequately to prevent electric field concentrations.

When the circuit breaker enters into an interrupting action as shown in FIG. 2(*b*), movable electrode 22 of the resistor closing contact S2 which is connected via connecting rod 27 to movable unit 41 of the main contact S1 (not shown) is caused to move in the direction of stationary electrode 12 at a high speed of 2–3 m per second integral with the movement of the movable unit 41. However, the movable shield 23 which is not directly connected to the movable electrode 22 cannot follow immediately its high speed movement due to inertia.

As a result, there occurs a relative movement between the movable electrode 22 and the shield 23 thereby causing the spring 24 to be compressed by the stopper 25 provided on the movable electrode 22. Then, along with restoration of the spring 24 to its free length, the shield 23 is caused to follow the movement of the movable electrode 22 lagging somewhat therefrom.

In this state, the movable electrode 22 is caused temporarily to protrude from the shield 23, thereby exposing front edge 22' of the movable electrode 22 at which a discharge tends to occur readily, thus reducing the shield effect of the shield 23, and in turn causing a high electric field to be present in the vicinity of the front edge of the movable electrode 22 so as to readily induce a preliminary discharge on the side of the resistor closing contact S2 in precedence to the main contact S1.

In reference to FIG. 2(*c*), when the closing action is completed, the shield 23 catches up the movement of the movable electrode 22 due to a restoration force of the spring 24, thereby, a mutual positional relationship between the movable electrode 22 and the shield 23 returns to the same mutual positional relationship as indicated in FIG. 2(*a*) to retain its state.

Further, in reference to FIG. 2(*d*), upon onset of an interrupting action, since the spring 24 is in a restored state to cause stopper 25 to latch a portion on the internal surface of the shield 23, the shield 23 is mechanically coupled to the movable electrode 22 to be carried integral therewith, thereby, the same shield effect for shielding the movable electrode 22 as attained during the fully open state of the contact can be implemented.

According to this embodiment of the invention having a simple structure for the resistor closing contact S2 in which the movable electrode 22 is inserted in the shield 23 movable to each other via the spring 24 interposed therebetween, there have been implemented such advantages that during the closing action of the circuit breaker, the shield effect on the side of the resistor closing contact S2 can be reduced to cause the resistor closing contact to discharge in precedence to the main contact S1, and that during the interrupting action and in the fully open state of the electrodes, the electric field shield effect for the resistor closing contact S2 can be enhanced to ensure the high insulation capability between their electrodes, thereby, an excellent insulation coordination characteristic by and large can be realized.

Further, at the time of closing operation of the circuit breaker, since the electric field on the side of the resistor closing contact S2 can be increased sufficiently by relatively protruding the front end of the movable electrode 22, a prior art wipe mechanism provided on the side of stationary electrode 12 can be deemed merely as a contact impact absorption mechanism, therefore, a conventional wipe length required to allow the stationary electrode 12 to protrude and retract into a stationary shield can be substantially shortened.

As a result, it becomes possible to minimize the overall size of the circuit breaker while ensuring the high performance insulation coordination according to the invention.

Figure 5:
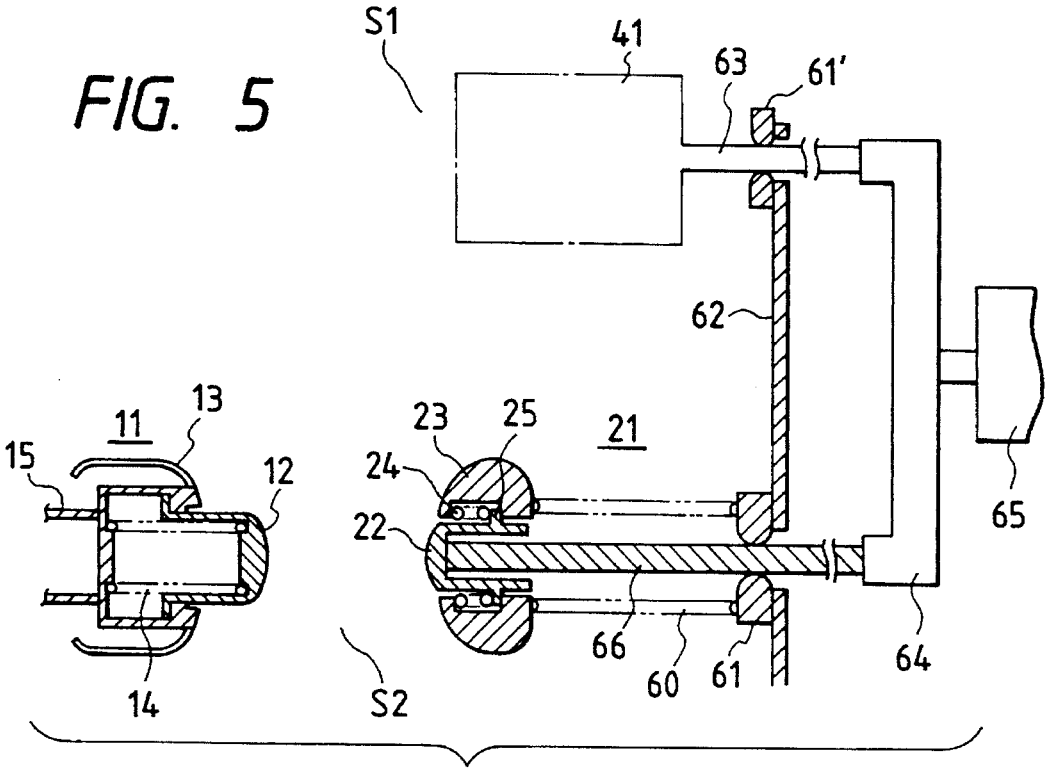
FIG. 5 is a schematic cross-sectional view of a second embodiment of the invention.

A second embodiment of the invention will be described in the following with reference to FIG. 5, the drawing of which is a cross-sectional view of a schematic structure of the second embodiment.

This second embodiment of the invention differs from the first embodiment in that an actuating method for actuating its movable electrode 22 is effected directly by a drive source (actuator cylinder 65) via an actuator rod 66. All other components and their internal structures including movable unit 41 of main contact S1, a stationary unit thereof (not shown), movable unit 21 on the side of resistor closing contact S2, and stationary unit thereof 11 are the same as those of the first embodiment of the invention.

Further, for shield 23 of the resistor closing contact S2, it is arranged such that when movable electrode 22 thereof is retracted to its maximum open position (i.e., full open distance) at the time of interruption, the shield 23 is stopped of its further backward movement by shield stopper member 60.

In this arrangement, operating rods 63 and 66 penetrate a conducting plate 62, at respective penetration positions thereof are provided support members 61', 61 for slidably supporting the operating rods 63, 66 which are electrically connected each other via the conducting plate 62. Further, spring 60 is fixed at its one end to a operating rods slidable support member 61.

At the time of closing and interrupting actions of the circuit breaker, the unit 41 on the side of main contact S1 and the movable electrode 22 on the side of the resistor closing contact S2 are driven by actuating cylinder 65 via rods 63 and 66.

In the above arrangement, during a closing action of the circuit breaker, shield 23 of movable unit 21 on the side of the resistor closing contact S2 is caused to move behind the movement of the movable electrode 22 due to compression of spring 24, and catch up the movement thereof due to restoration, while during an interrupting action thereof, the shield 23 is caused to move backward integral with the movable electrode 22 in a manner as described in the first embodiment of the invention.

According to the second embodiment of the invention, the same advantages and merits as in the first embodiment have been accomplished, and in addition, the following advantages can be accomplished as well.

In the prior art arrangement, a reciprocating motion of shield 23 often occurs since the shield cannot stop immediately due to its inertia even when operating rods 66 is stopped, thereby overshooting in the direction of operating rods slidable support member 61, then being pulled back by spring 24. However, according to the present invention, such an undesirable situation as above can be prevented by providing shield stopper member 60, thereby, the shield 23 at its full open distance upon completion of interruption operation can retain its position by means of the shield stopper member 60.

According to the second embodiment of the invention, it is possible completely to prevent the movable electrode 22 from protruding into a space between the electrodes thereof due to overshooting of the shield 23 even for a short duration of time upon completion of interrupting action, thereby any decrease in its insulation property can be suppressed. Further, since its state of interruption can be maintained until the next closing action, a stable insulation property can be retained advantageously.

Figure 6A:
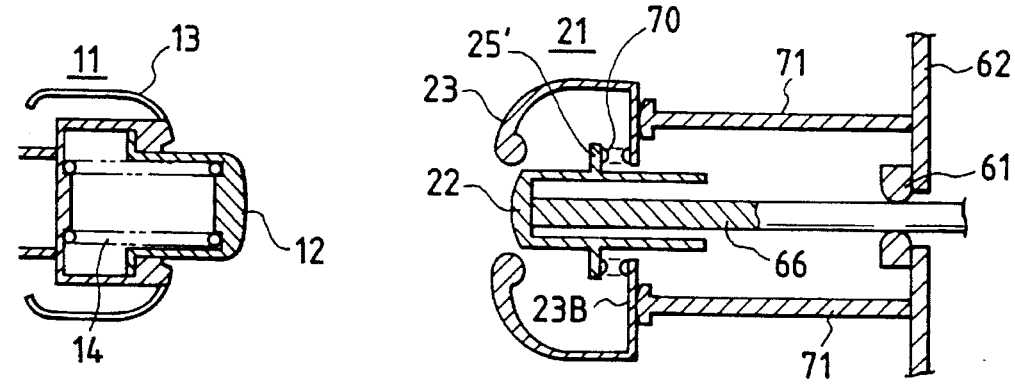
FIG. 6A–C are a schematic cross-sectional view of a third embodiment of the invention.
Figure 6B:
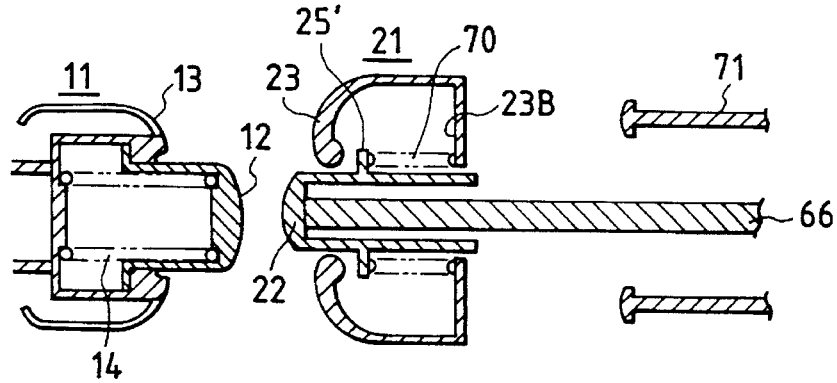
Figure 6C:
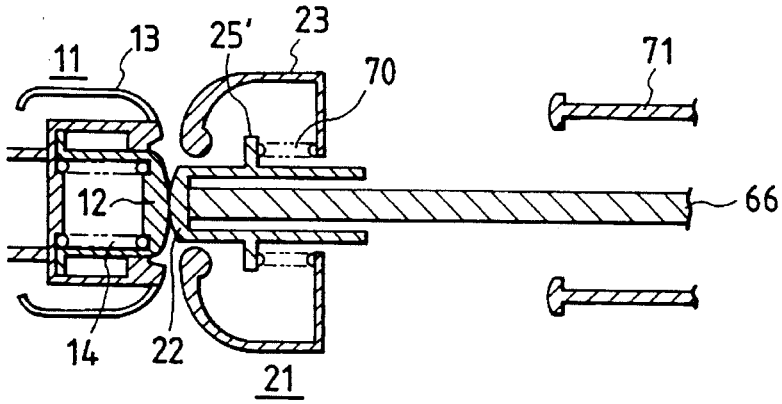

A third embodiment of the invention now will be described with reference to FIG. 6. In the drawing of FIG. 6, there are shown only the arrangement of resistor closing contact S2 and its action. With respect to its main contact S1, it is the same as ones in the first and the second embodiments. In particular, with respect to its actuating method, the operating rods actuating method of the second embodiment is employed.

Movable unit 21, in particular, on the side of resistance closing contact S2 will be described in detail.

The movable unit 21 on the side of resistance closing contact S2 includes a movable electrode 22 which is movable integral with movable unit 41 on the side of main contact S1, and a shield 23 provided for relaxing electric field concentration around the movable electrode 22.

In the third embodiment of the invention, the shield 23 is fit around the movable electrode 22 in such a manner as to allow both to move in the axial directions relative to each other, with a tension spring 70 being interposed between the inner surface of the shield 23 and the outer surface of the movable electrode 22, which is identical with the foregoing embodiments of the invention described above, however, it differs from their arrangements, in particular, in the following features.

That is, one end of spring 70 facing stationary unit 11 on the side of resistance closing contact S2 is latched on stopper 25' provided on the outer surface of the movable electrode 22, and the other end of the spring which is opposite to the stationary unit is latched on rear inner surface 23B of the shield 23.

Further, during interrupting action of the main contact S1, when the shield 23 is moved backward to a position immediately in front of a predetermined full open position (maximum open distance) relative to the stationary electrode 12, it is stopped of its further movement by shield stopper member 71, thereby, further backward movement is allowed only to the movable electrode 22 involving compression of the spring 70. In this instance, the movable electrode 22 is retracted into the shield 23. The shield stopper member 71 is installed on conducting plate 66 which has been described in the foregoing embodiment in reference to FIG. 5.

Further, when the movable electrode 22 is caused to advance toward the stationary electrode 12 during closing action, the spring 70 is released of its compression transient1y extending than its free length due to reaction, as a result, causing the shield 23 to retreat relative to the movable electrode 22.

Action of this embodiment of the invention will be described with reference to steps (a) to (c) in the drawing of FIG. 6.

In FIG. 6, (a) is a state in which the contact is fully open, (b) is a state under closing action, and (c) is a state at which closing action is complete.

In the state (a) where the contact is fully open, the shield 23 subjected to a pressure from shield stopper member 71 is adapted to compress spring 70 which connects the shield 23 and the movable electrode 22. In this instance, the front end of the movable electrode 22 is retracted into the shield 23, namely, covered by the shield 23, so as to sufficiently relax the electric field around the movable electrode 22.

When it enters from this state (a) into a closing action as indicated in (b), the movable electrode 22 is caused to move toward a stationary electrode at a high speed driven by operating rods 66. In this instance, spring 70 is released from its compressed state to expand beyond its free length due to its reaction thus to assume a state of tension, which serves as an acting force to move the shield 23 backward in the reverse direction relative to the closing direction. At this instant, the front end of the movable electrode 22 protrudes from the enclosure of the shield 23, as a result, it induces a high electric field concentration in the vicinity thereof, thereby readily causing a preliminary discharge to occur on the side of the resistance closing contact S2 in precedence to the main contact S1.

In the next step (c) of FIG. 6 indicative of complete closing action, the spring 22 retains its free length. In this state, a mutual positional relationship between the movable electrode 22 and the shield 23 is set such that the front end surface of the movable electrode 22 is enclosed within a curve extending over an opening in the front surface of the shield.

In a subsequent interrupting action which is not shown in the drawing, the operating rods 66 is pulled back at a high speed in the right-hand direction on the drawing, thereby causing the movable electrode 22 and the shield 23 to move backward integral with each other in the state retaining FIG. 6(*c*), that is, maintaining the shield effect of the invention.

Arriving at a position immediately before the complete interruption position, the shield 23 is stopped of its further backward movement by shield stopper member 71, thereby, allowing any further backward movement only to the movable electrode 22 involving compression of the spring 70, in consequence, the movable electrode 22 is retracted into the shield 23 to return to the state of (a) in the same drawing.

The shield stopper member 71 and the spring 70 in conjunction also work to suppress the reciprocal oscillation of the movable shield 23 upon completion of the interrupting action in the same manner as in the second embodiment of the invention. By way of example, the shield stopper member 71 may be supported by the operating rods slidable support member 61 described above.

According to the third embodiment of the invention, which has the same advantages and merits as implemented by the first and the second embodiments, can have another advantage that it becomes more certain for the shield for enclosing the movable electrode on the side of the resistance closing contact to be secured more stably.

Figure 7A:
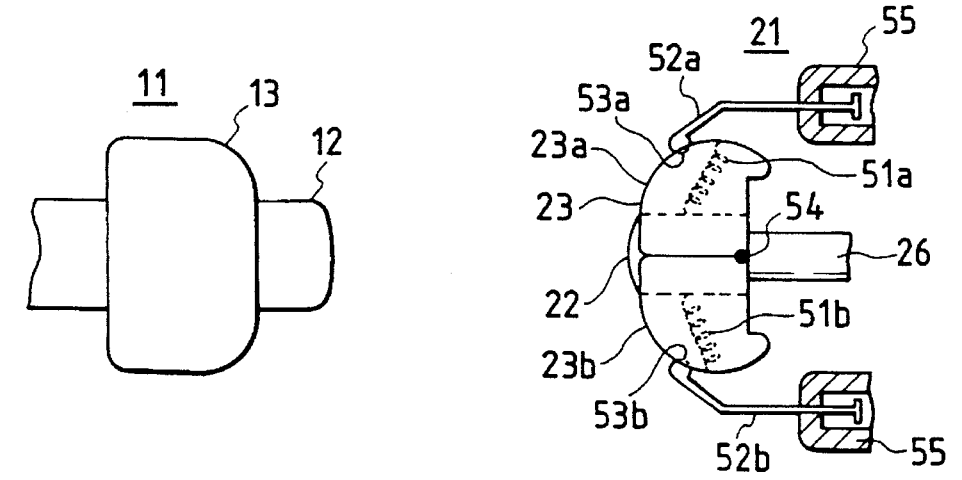
FIG. 7A–C are a schematic cross-sectional view of a fourth embodiment of the invention.
Figure 7B:
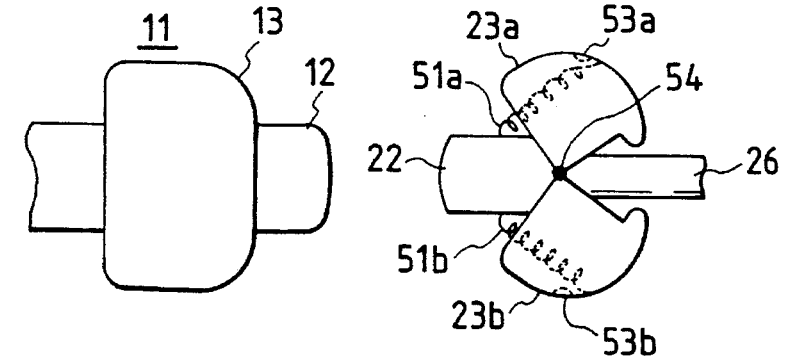
Figure 7C:
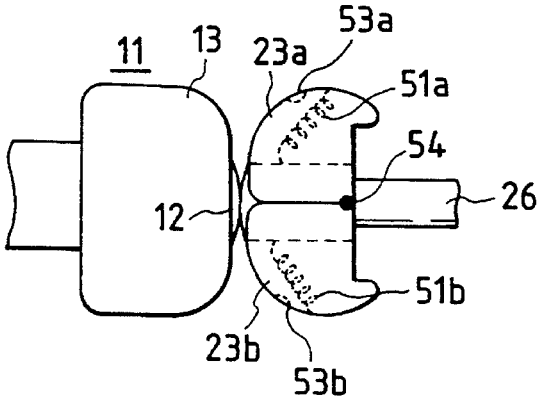

A fourth embodiment of a resistance closing contact S2 according to the invention will be described with reference to FIG. 7. In the drawing of FIG. 7, its main contact S1 is omitted since its arrangement and action are the same as described in the first embodiment.

In FIG. 7, (a) indicates a state in which its contact is full open, (b) indicates a state under closing action, and (c) indicates a state at a complete closing action. A major difference from the first embodiment is in the structure of a movable unit 21 on the movable side of the resistance closing contact S2.

The movable unit 21 of the resistance closing contact S2 in this embodiment also comprises a movable electrode 22 which is movable integral with movable unit 41 on the side of the main contact S1, and a shield 23.

The shield 23 in the above movable unit 21 includes shield elements 23*a*, 23*b* which separate into two portions around a pivot on an axial line of the movable electrode 22 so as to provide an opening for a front end of the movable electrode 22. Thereby, when the movable electrode 22 of the resistance closing contact S2 is caused to move toward its stationary electrode 12 during closing action of the main contact S1, the shield elements 23*a* and 23*b* are separated to assume an open state and thus expose the movable electrode 22, while at the time of interrupting action of main contact S1, the movable electrode 22 is arranged to enter into an open action with the shield elements 23*a* and 23*b* being closed.

Namely, in this embodiment of the invention, shield elements 23*a*, 23*b* are pivotally mounted on a body member of the movable electrode 22, and the shield elements 23*a*, 23*b* are urged by means of springs 51*a*, 51*b* in respective directions to close the shield 23. Each of the springs 51*a*, 5*1*b is fixed at one end thereof to a portion on the outer surface of the body of the movable electrode 22, while the other end thereof is fixed to a portion on the inner surface of either of the shield elements 23*a*, 23*b*. Thereby, the shield elements 23*a*, 23*b* can be urged into their closing directions whenever a tensile force is exerted on the spring.

Further, as indicated in FIG. 7(*a*), when the movable electrode 22 is at its full open position, shield elements 23*a*, 23*b* which are in a closed state are latched between latch members 52*a*, 52*b* which are fixed at the full open position. 55 denotes a support member for supporting the latch members 52*a*, 52*b*.

The latch members 52*a*, 52*b* are adapted to release the shield elements 23*a*, 23*b* when a force beyond a predetermined value is applied between the latch members 52*a*, 52*b* and the shield elements 23*a*, 23*b*.

In the state of FIG. 7(*a*), the front end surface of the movable electrode 22 is adapted not to protrude from a curve extending on the front surface of the shield 23 which is closed, thereby, the shield 23 in a closed state acts to relax the electric field in the vicinity of the front end of the movable electrode 22.

In the next step, when it enters into a closing action, and the movable electrode 22 moves toward stationary electrode 12 (this movement is enabled in the same manner as in the first embodiment, i.e., being moved integral with the movable unit on the side of main contact S1), shield elements 23*a*, 23*b* are forced to open due to latching between latch members 52*a* and 52*b* against forces of springs 51*a*, 51*b*. This shield opening action is enabled by rotation of shield elements 23*a*, 23*b* around a pivot 54 to part into two divisions. When this opening action proceeds, latching between the shield elements 23*a*, 23*b* and the latch members 2*a*, 52*b* is released to enter into a state as indicated by (b) in the same drawing.

Thereby, the shield elements 23*a*, 23*b* while retaining their open state are adapted to move toward stationary unit 11 on the side of resistance closing contact S2 carried by the movable electrode 22.

In this instance, since the movable electrode 22 is moved at a high speed in an environment filled with a gas to a pressure of 5–6 atmospheres, the shield elements 23*a*, 23*b* once in an open state further increase their degrees of open state during their travel to the stationary unit 11. Thereby, the front end portion of the movable electrode 22 is caused to protrude from the shield elements 23*a*, 23*b* to be exposed to the electric field, thereby, inducing a high electric field concentration therearound, and thus, readily causing a preliminary discharge to occur on the side of the resistance closing contact in precedence to the main contact S1 as intended according to the invention.

At the time when closing action is complete as indicated in FIG. 7(*c*), the shield elements 23*a*, 23*b* are pulled back from their open state by tensile forces of springs 51*a*, 51*b* substantially to enclose the movable electrode 22. This closed state will be retained until a next action.

In the next step, that is, during interrupting action, although it is not shown in the diagram, the movable electrode 21 is moved in the right-hand direction on the drawing (i.e., toward the position at which the contact is full open) while maintaining the shield elements in closed state. The closed shield 23 in this instance can provide an adequate shield effect around the front end portion of the movable electrode 11 in the same manner as has been implemented in the full open state of the contact. During this interrupting action, since the shield elements 23*a*, 23*b* are adapted directly to be subjected to a wind pressure which confronts a rotation thereof, thus, eventually enforcing the tensile strength of springs 51*a*, 51*b*, the shield elements 23*a*, 23*b* are ensured to be closed all the while during interrupting action. When they arrive at the position at which the contacts are full open, respective edge points of latch members 53*a*, 53*b* are adapted to engage into respective notches provided in the surfaces of respective shield elements 23*a*, 23*b*, thus, the shield elements return to the state of FIG. 7(*a*).

According to this embodiment of the invention described above, a high electric field can be produced on the side of the resistance closing contact during closing action, and on the other hand, during interrupting action and at the full open state of contacts, a high insulation capability can be ensured, likewise according to the foregoing embodiments of the invention. In addition, the gas pressures exerting on the shield elements during their movements in both directions ensure their expected actions to be fulfilled. Although, in this fourth embodiment of the invention, the shield has been described that it can be divided into two portions which rotate around a pivot, however, the number of division is not limited thereto, and any number of division more than two may be applicable within the scope of the invention.

Figure 8:
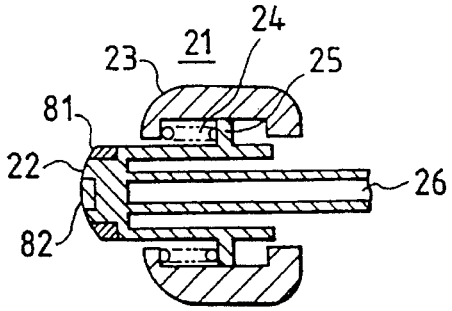
FIG. 8 is a schematic cross-sectional view of a fifth embodiment of the invention.

A fifth embodiment of the invention will be described in the following with reference to FIG. 8, the drawing of which illustrates only a movable unit 21 thereof, with its movable electrode in a state of closing action. The construction of movable unit 21 other than the feature of the fifth embodiment are identical with that of the first embodiment of the invention.

The main feature of this embodiment is in that a high arc withstanding metal 81 is embedded in front edge portions of movable electrode 22, and a high hardness metal 82 is utilized on the front contact portion of a movable contact thereof.

In all of the embodiments of the invention described above, electric field concentration is intended to be caused to occur in the vicinity of front end edge portions of movable electrode 22 thereby to induce a preliminary discharge thereon in precedence to the main contact. Damage due to the preliminary arc can be minimized by embedding in these regions a large arc withstanding metal 81 with a low electric resistance and a high thermal conductivity. On the other hand, a high insulation performance of the movable electrode 22 must be maintained during interrupting action and at the full open position of the contacts since a maximum electric field on the side of movable unit 21 may easily concentrate thereon. However, the front contact portion thereof is likely to be damaged at the time of closing due to mechanical impact against a front contact portion of a stationary electrode on the side of the stationary unit. Since any preliminary discharge will not occur from the front contact portion, high hardness metal 82 having a high mechanical resistance to damages was employed therein.

An improved performance and reliability of circuit breaker equipment can be attained according to this fifth embodiment of the invention since the most suitable material can be selected for respective portions of the movable electrode, that is, specifically for each of the preliminary discharge inducing portion, impact-withstand and/or insulating portions or the like.

The advantages and merits of the invention described above may be summarized as follows. A highly reliable circuit breaker with parallel resistance has been realized according to the invention, in which the movable unit on the side of its resistance closing contact has employed a simple construction to allow its shield effect for shielding the movable electrode to be altered between the closing action and the interrupting action thereby to ensure an excellent insulation coordination to be achieved.

Further, the prior art wipe mechanism which has been provided on the side of the stationary electrode can be deemed simply as a contacting impact absorption mechanism, since the movable electrode of the invention can be protruded relative to the shield during closing action to sufficiently increase the electric field on the side of the resistance closing contact, thereby, a wipe length required to pull in and out the stationary electrode relative to the stationary shield can be minimized. In addition, since the front end of the movable electrode can be set within an envelope extending from the front curvature of the movable shield at the position where the contacts are full open, the interelectrode distance on the side of the resistance closing contact can be minimized accordingly while maintaining the improved shield effect and interelectrode insulation capability. As a result, a compacter circuit breaker still maintaining an excellent performance can be realized.

What is claimed is:

1. A circuit breaker with a parallel resistance, having a resistance closing contact (S2) coupled in parallel with a main contact (S1) for interrupting electric current, wherein interrupting and closing actions of a movable electrode (22) with respect to a stationary electrode (12) on the side of said resistance closing contact (S2) are adapted to precede interrupting and closing actions of said main contact (S1), wherein a movable unit (21) on the side of said resistance closing contact (S2) comprises:

the movable electrode (22) which is adapted to move integral with a movable unit (41) on the side of said main contact (S1); and an electric field relaxation shield (23) for relaxing electric field around said movable electrode (22), wherein said shield (23) is adapted to fit on said movable electrode (22) allowing its relative movement relative to said movable electrode (22) via an elastic member (24) in the axial directions such that when said movable electrode (22) of said resistance closing contact (S2) moves toward the stationary electrode (12) thereof during a closing action of said main contact (S1), compression of said elastic member (24) allows a relative movement due to inertia between said movable electrode (22) and said shield (23), then followed by restoration of said elastic member (24), these compression and restoration of the elastic member in conjunction enabling said shield (23) to follow lagging behind a forward movement of said movable electrode (22), and during an interrupting action of said main contact (S1), said shield (23) which is now latched to said movable electrode (22) of said resistance closing contact (S2) by means of said elastic member (24) in a restored state is caused to move integral with said movable electrode (22) in a backward direction which is opposite to the stationary electrode.

2. The circuit breaker with a parallel resistance according to claim 1 wherein said elastic member (24) is interposed between the inner surface of said shield (23) and the outer surface of said movable electrode (22), one end of said elastic member (24) on the side of the stationary unit (11) of the resistance closing contact (S2) being attached to an inner wall of said shield (23), while the other end thereof on a remote side from the stationary unit being attached to a stopper (25) provided on the outer surface of said movable electrode (22).

3. A circuit breaker with a parallel resistance according to claim 1 wherein said movable electrode (22) of said resistance closing contact (S2) is supported by a cylinder (44) of the movable unit (41) on the side of said main contact (S1) via a connecting member (27) so as to move integral with said movable unit (41) when said movable unit (41) is actuated for closing or interrupting actions.

4. A circuit breaker with a parallel resistance according to claim 1 wherein the movable unit (41) on the side of said main contact (S1) and the movable electrode (22) on the side of said resistance closing contact (S2) are connected via respective operating rods (63, 66) to a common actuator (65).

5. A circuit breaker with a parallel resistance according to claim 4 wherein the shield (23) of said resistance closing contact (S2) is adapted to be stopped by a shield stopper (60) when the movable electrode (22) thereof is retracted by said operating rods (66) to a predetermined position which is a maximum contact open position.

6. A circuit breaker with a parallel resistance, having a resistance closing contact (S2) coupled in parallel with a main contact (S1) for interrupting electric current, wherein interrupting and closing actions of a movable electrode (22) with respect to a stationary electrode (12) on the side of said resistance closing contact (S2) are adapted to precede interrupting and closing actions of said main contact (S1), wherein a movable unit (21) on the side of said resistance closing contact (S2) comprises:

the movable electrode (22) which is adapted to move integral with a movable unit (41) on the side of said main contact (S1); and an electric field relaxation shield (23) for relaxing electric field around said movable electrode (22), wherein said shield (23) is adapted to fit on said movable electrode (22) allowing a relative movement relative to said movable electrode (22) in the axial directions thereof, an elastic member (70) being interposed between an internal surface of said shield (23) and an outer surface of said movable electrode (22), one end of said elastic member (70) near to a stationary unit (11) of the resistance closing contact (S2) being fastened to a stopper (25') provided on the outer surface of said movable electrode (22) while the other end of the elastic member remote from the stationary unit being fastened to a rear inner wall (23B) of said shield (23), further wherein, during an interrupting action of said main contact (S1), said shield (23) is stopped by a shield stopper (71) when said shield is retracted to a predetermined position which is in front of a maximum contact open position relative to said stationary electrode (12), whereby a further backward movement is allowed only to said movable electrode (22) involving compression of said elastic member (70) in such a manner to retract said movable electrode (22) into said shield (23), and wherein, during a closing action, when said movable electrode (22) is caused to move forward to said stationary electrode (12), said elastic member (70) is released from a state of compaction temporarily to expand than its free length due to reaction of release thereby said shield (23) being moved backward accordingly relative to said movable electrode (22).

7. A circuit breaker with a parallel resistance according to claim 1 wherein said elastic member comprises a spring.

8. A circuit breaker with a parallel resistance, having a resistance closing contact (S2) coupled in parallel with a main contact (S1) for interrupting electric current, wherein interrupting and closing actions of a movable electrode (22) with respect to a stationary electrode (12) on the side of said resistance closing contact (S2) are adapted to precede interrupting and closing actions of said main contact (S1), wherein a movable unit (21) on the side of said resistance closing contact (S2) comprises the movable electrode (22) which is adapted to move integral with a movable unit (41) on the side of said main contact (S1), and an electric field relaxation shield (23) for relaxing electric field around said movable electrode (22), wherein said shield (23) comprises shield elements (**23*a*, 23*b*) which are mounted rotatably to open at a front end of said shield facing a front end of said movable electrode (22) to separate into divisions around an axial line of said movable electrode (22), and wherein said shield elements (23***a*, 23*b*) are adapted temporarily to open only when the movable electrode (22) of said resistance closing contact (S2) is caused to move towards the stationary electrode (12) during a closing action of said main contact (S1).

9. A circuit breaker with a parallel resistance according to claim 8 wherein said shield elements (23*a*, 23*b*) pivotally mounted to rotate around a pivot on a side portion of said movable electrode (22) are urged in a closing direction by springs (51*a*, 51*b*), wherein when said movable electrode (22) is positioned at a predetermined position of a maximum open distance from said stationary electrode (12), said shield elements (23*a*, 23*b*) are latched to latch members (52*a*, 52*b*) which are fastened in the vicinity of the predetermined position of the maximum open distance, and wherein, at the time of closing action, said shield elements (23*a*, 23*b*) which are latched to said latch members (52*a*, 52*b*) are forced to open as latched resisting a force of said springs (51*a*, 51*b*), thus the opening action of which releasing latching between said shield elements (23*a*, 23*b*) and said latch members (52*a*, 52*b*).

10. A circuit breaker with a parallel resistance according to claim 1 wherein said movable electrode (22) comprises different types of metals to be embedded respectively in a front end portion and edge portions thereof, a metal to be used in the front end portion being a high hardness metal, a metal to be used in the edge portions being an arc resistant metal.

11. A circuit breaker with a parallel resistance according to claim 2 wherein said movable electrode (22) of said resistance closing contact (S2) is supported by a cylinder (44) of the movable unit (41) on the side of said main contact (S1) via a connecting member (27) so as to move integral with said movable unit (41) when said movable unit (41) is actuated for closing or interrupting actions.

12. A circuit breaker with a parallel resistance according to claim 2 wherein the movable unit (41) on the side of said main contact (S1) and the movable electrode (22) on the side of said resistance closing contact (S2) are connected via respective operating rods (63, 66) to a common actuator (65).

13. A circuit breaker with a parallel resistance according to claim 2 wherein said movable electrode (22) comprises different types of metals to be embedded respectively in a front end portion and edge portions thereof, a metal to be used in the front end portion being a high hardness metal, a metal to be used in the edge portions being an arc resistant metal.

14. A circuit breaker with a parallel resistance according to claim 3 wherein said movable electrode (22) comprises different types of metals to be embedded respectively in a front end portion and edge portions thereof, a metal to be used in the front end portion being a high hardness metal, a metal to be used in the edge portions being an arc resistant metal.

15. A circuit breaker with a parallel resistance according to claim 4 wherein said movable electrode (22) comprises different types of metals to be embedded respectively in a front end portion and edge portions thereof, a metal to be used in the front end portion being a high hardness metal, a metal to be used in the edge portions being an arc resistant metal.

16. A circuit breaker with a parallel resistance according to claim 5 wherein said movable electrode (22) comprises different types of metals to be embedded respectively in a front end portion and edge portions thereof, a metal to be used in the front end portion being a high hardness metal, a metal to be used in the edge portions being an arc resistant metal.

17. A circuit breaker with a parallel resistance according to claim 6 wherein said movable electrode (22) comprises different types of metals to be embedded respectively in a front end portion and edge portions thereof, a metal to be used in the front end portion being a high hardness metal, a metal to be used in the edge portions being an arc resistant metal.

18. A circuit breaker with a parallel resistance according to claim 7 wherein said movable electrode (22) comprises different types of metals to be embedded respectively in a front end portion and edge portions thereof, a metal to be used in the front end portion being a high hardness metal, a metal to be used in the edge portions being an arc resistant metal.

19. A circuit breaker with a parallel resistance according to claim 8 wherein said movable electrode (22) comprises different types of metals to be embedded respectively in a front end portion and edge portions thereof, a metal to be used in the front end portion being a high hardness metal, a metal to be used in the edge portions being an arc resistant metal.

20. A circuit breaker with a parallel resistance according to claim 9 wherein said movable electrode (22) comprises different types of metals to be embedded respectively in a front end portion and edge portions thereof, a metal to be used in the front end portion being a high hardness metal, a metal to be used in the edge portions being an arc resistant metal.

* * * * *